United States Patent [19]

Parry

[11] Patent Number: 4,722,157

[45] Date of Patent: Feb. 2, 1988

[54] BUILDING FRAME SUPPORT

[76] Inventor: Rodger J. Parry, 506 Limber Rd., Meadville, Pa. 16335

[21] Appl. No.: 46,113

[22] Filed: May 5, 1987

Related U.S. Application Data

[62] Division of Ser. No. 741,929, Jun. 6, 1985, Pat. No. 4,662,146.

[51] Int. Cl.[4] ..... E02D 27/42; E04H 12/22; E04H 12/34; E05D 7/10

[52] U.S. Cl. ..... 52/298; 52/120; 16/262; 16/267; 16/386

[58] Field of Search ..... 52/116, 120, 298; 16/262, 267, 374, 380, 386

[56] References Cited

U.S. PATENT DOCUMENTS 3,130,651 4/1964 Werner ..... 16/267
3,333,726 8/1967 Belanger ..... 16/267

FOREIGN PATENT DOCUMENTS 325365 2/1930 United Kingdom ..... 16/262

*Primary Examiner*—William F. Pate, III
*Assistant Examiner*—Michael Safavi
*Attorney, Agent, or Firm*—Charles L. Lovercheck; Wayne L. Lovercheck; Dale R. Lovercheck

[57] ABSTRACT

A method and apparatus for erecting buildings is disclosed. The method involves providing frame elements of a building which may be made up of spaced columns connected together by a beam or beams which may meet at a gable. To erect the frames, each frame is disposed horizontally on the ground with bases of the columns attached by a hinge member to a footing. A spacer bar is supported with one end in a recess in the ground or attached to the frame. A tension member such as a cable is attached to the frame at the gable and is passed over the top end of the spacer post and a vehicle or other prime mover is attached to the tension member to pull the frame to erect position. Each of the hinge members may be made of a socket to attach to the base of a column and a shoe attached to a ground support footing. Each socket is hinged to the shoe by a forwardly facing slot that receives a pin on the socket. The slot is so shaped that the pin can enter it when the column is in horizontal position, but the pin cannot slip out of the slot when the column is raised away from the horizontal position. A second pin is provided which extends through flanges on the shoe and through flanges on the socket when the column is in erect position.

2 Claims, 9 Drawing Figures

BUILDING FRAME SUPPORT

REFERENCE TO PRIOR PATENT

This is a division of application Ser. No. 741,929, filed June 6, 1985, issued as U.S. Pat. No. 4,662,146 on May 5, 1987.

REFERENCE TO THE PRIOR ART

Various gin poles and cranes and other apparatus have been provided for erecting building frames, but Applicant knows of no method that has been used where a prime mover is connected to a building structure with the structure hinged to the ground and the structure then pulled into erect position. Applicant is aware of the following patents on hinge structures for connecting columns to bases, however, Applicant believes these hinge members are not suggestive of Applicant's structure or method.

U.S. Pat. No. 805,201 shows a fence post pivoted to a ground member. U.S. Pat. No. 3,051,113 shows an apparatus for supporting offshore floating loads. U.S. Pat. No. 2,605,865 shows an island strip support wherein the column structure is supported on ground anchors.

OBJECTS OF THE INVENTION

It is an object of the invention to provide an improved method of erecting a building structure.

Another object of the invention is to provide an improved hinge member for connecting a column to a footing member.

Another object of the invention is to provide a method of erecting buildings that is simple, economical to carry out, and simple and efficient to use.

With the above and other objects in view, the present invention consists of the combination and arrangement of parts hereinafter more fully described, illustrated in the accompanying drawing and more particularly pointed out in the appended claims, it being understood that changes may be made in the form, size, proportions and minor details of construction without departing from the spirit or sacrificing any of the advantages of the invention.

GENERAL DESCRIPTION OF THE DRAWINGS

DETAILED DESCRIPTION OF DRAWINGS

Figure 1:
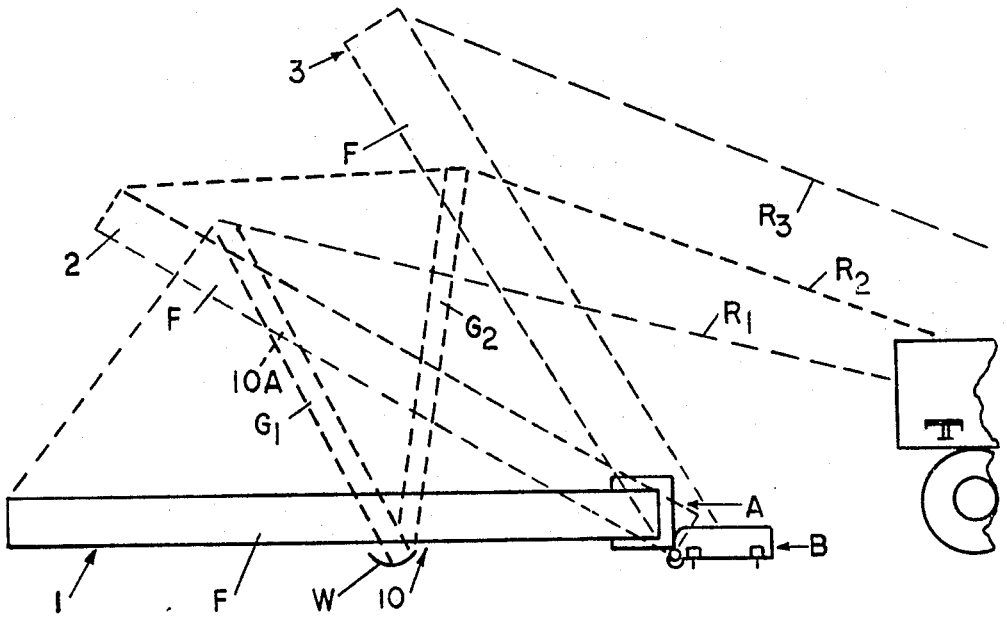
FIG. 1 is a side view of a prime mover connected to a building frame member which is connected to a footing by an improved hinge member ready to pull the building structure to erect position.

Now, with more particular reference to the drawings, I show a plurality of footings E which are set into the ground in accordance with good building practices. The footings may be spaced in accordance with the requirements specified by an architect or builder. The footings E may be in the form of concrete posts set in the ground, for example three feet below the ground surface.

The frames F are made up of columns C with rafters R supported on their upper end and connected together at a gable G. The columns may be made of wooden column members and the rafters may be made of steel or any other materials suitable for the particular purpose.

The shoe B has a flat bottom 12, spaced sides 13 each having a flange 14 extending upwardly therefrom at the rear end thereof.

Forwardly opening slots S are formed in each of the sides 13 adjacent the front end and adjacent the bottom. The slots are cylindrical in shape and have flat bottoms 30' that are flush with the top of the flat bottom 12.

The sockets A have a flat bottom 16 and sides 19. The pintels P extend out laterally from each side and when a column C is received in the socket A with the lower end of the column C resting on the top of the bottom 16 of the socket and the column laying horizontally on the ground, the flat surface 20 of the pin P will be co-planar with the flat bottom 30' of the slots S so that the pins can be slid into the slots. Then when the column is swung upward to erect position the flat surface 20 of the pintels will be perpendicular to the bottom flat surfaces of the slots S so that the column cannot be removed.

The spacer post G1 in FIG. 1 may have its lower end set in a recess W in the ground and the tension member R which may be a rope or cable may pass over the top of the spacer post G1 and attach to the truck T. As the truck moves forward, the tension member R will exert a force on the upper end of the frame F which will swing the spacer post G1 through the position G2 and at the same time lift the frame. As the frame F moves from position 1 to position 3, the post G1 will fall away and the tension on the tensil member R3 will be directly from the truck to the frame F. The truck will then pull the frame into erect position and at that point a pin will be inserted into the holes H1 and H2 which will be aligned at that time, thereby holding the frame in erect position.

Figure 2:
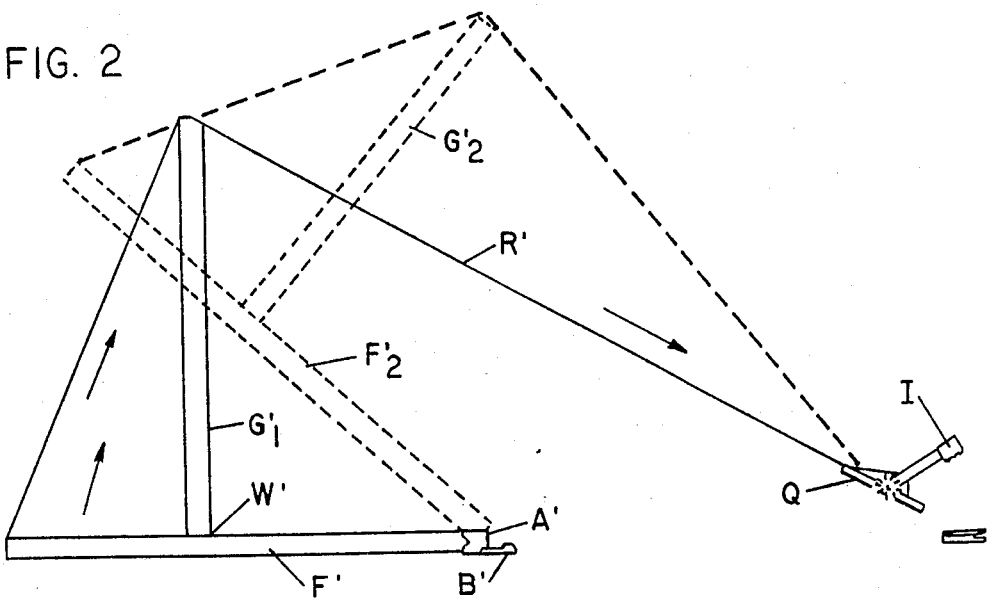
FIG. 2 is a view of a different embodiment of the method of erecting buildings.
Figure 3:
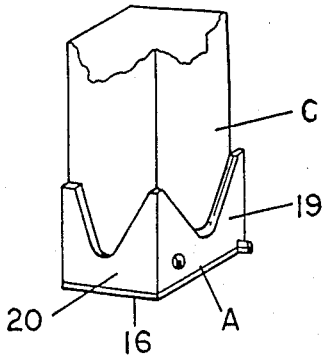
FIG. 3 is an enlarged partial view of the lower end of a column supported on a socket according to the invention.
Figure 4:
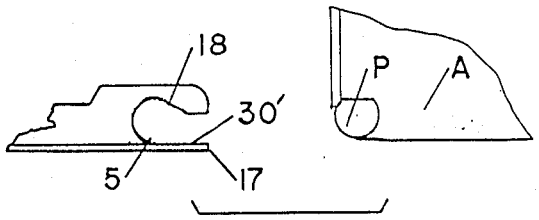
FIG. 4 is an enlarged exploded partial view of a part of the socket and the shoe used in the hinge connection for connecting the column to a footing.
Figure 5:
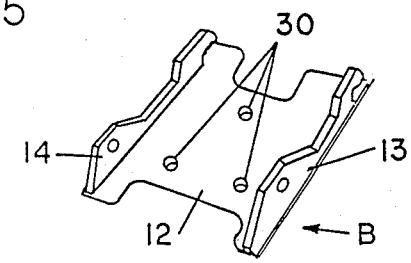
FIG. 5 is an isometric view of the shoe member.
Figure 6:
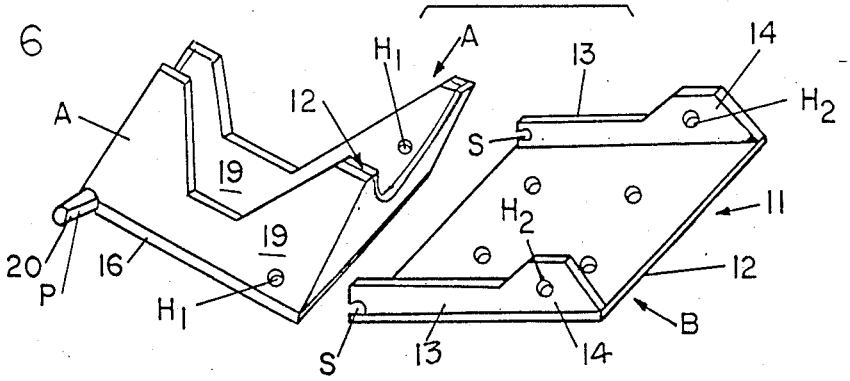
FIG. 6 is an exploded view showing a socket member and a shoe member according to the invention.
Figure 7:
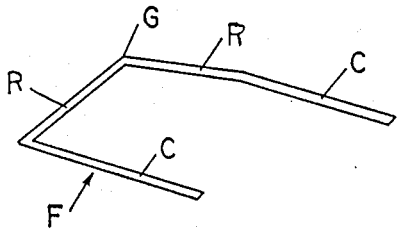
FIG. 7 is an isometric view of a building frame member.
Figure 8:
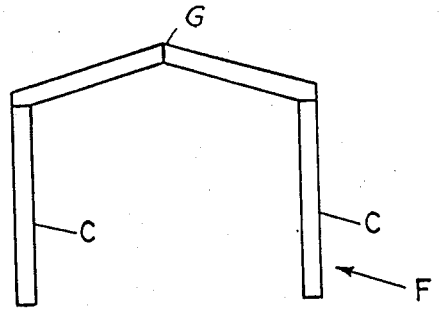
FIG. 8 is a front view of a building frame member.
Figure 9:
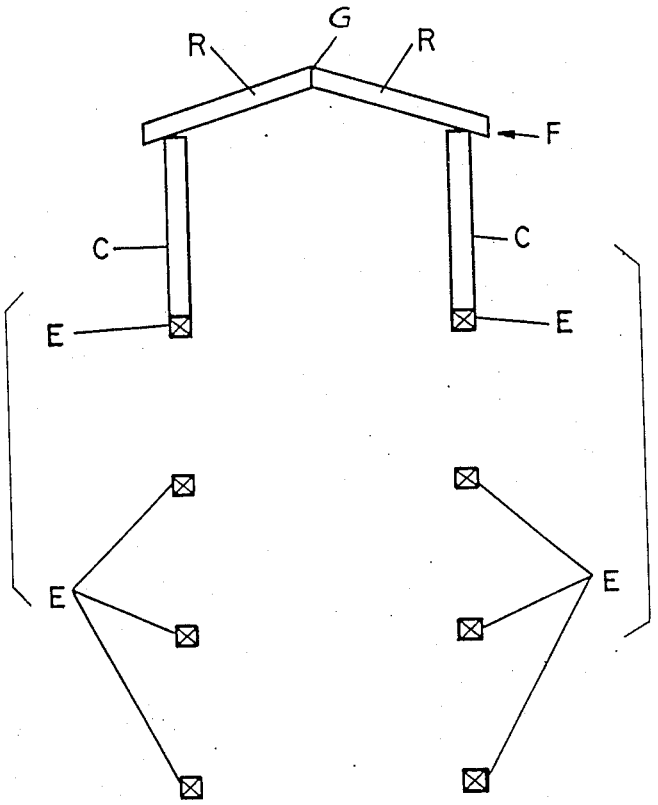
FIG. 9 shows a frame member similar to FIG. 8 supporting adjacent a plurality of footings for providing a building arrangement.

In the embodiment of the invention shown in FIG. 2, a spacer G'1 is fixed to the frame F' at W'. The tensil member R' is passed from the upper end of the frame F' around the top of the spacer G'1 and then to the tensil member Q which may be a cable tightener of a type familiar to those skilled in the art or the like having a handle I. As the tensil member R' is tightened, the cable will pull the frame up to the position F'2 and the spacer G'1 will be pulled to the position G'2 and from thence the cable will pull the frame to erect position. The hinge members A' and B' are shown supporting the lower end of the frame.

Holes 30 are formed in the bottom 12 of the shoe B for attaching the shoe to a footing E or the like. Holes H2 in each of the flanges of the shoe will align with holes H1 in the sides of the socket member A. Thus, when the column C is in erect position, the holes H1 will align with the holes H2 and a pin can be extended through the holes H1 and the holes H2 to hold the column in erect position.

The foregoing specification sets forth the invention in its preferred, practical forms but the structure shown is capable of modification within a range of equivalents without departing from the invention which is to be understood is broadly novel as is commensurate with the appended claims.

The embodiments of the invention in which an exclusive property or privilege is claimed as defined as follows:

1. In combination a shoe member and a socket member for supporting a column comprising:

a shoe member and a socket member, said shoe member comprising a flat, generally rectangular bottom member, and spaced sides, said generally rectangular bottom member of said shoe having a first side edge, a second side edge, a first end, a second end and means on said bottom member of said shoe for attaching said shoe member to a footing, said sides being fixed to said bottom member of said shoe at said first side edge and said second side edge of said rectangular bottom member and said sides extending upwardly from said bottom member and defining a space therebetween, said sides of said shoe each having a slot adjacent said bottom and adjacent said first end of said bottom member, said socket member comprising a flat generally rectangular plate-like bottom member having spaced side edges, a first end and a second end and two spaced upwardly extending sides fixed to said side edges, said socket having a first pintel fixed to one said side and a second pintel fixed to another said side adjacent said bottom member and adjacent said first end, said socket being adapted to receive an end of a column therein in the space between said sides of said socket and means on said socket to attach said column to said socket, said shoe being adapted to receive said socket with said bottom of said shoe disposed in a plane generally parallel to said bottom of said socket, said sides of said socket received between said sides of said shoe and said pintels being received in said slots whereby said column can be attached to said socket and swung from a horizontal position to a vertical position, locking means on said shoe and on said socket to lock said socket to said shoe when said socket and said column are swung to a vertical position.

2. The combination recited in claim 1 wherein said locking means comprises a first hole in said sides of said shoe and a second hole in said sides of said socket, said holes in said sides of said shoe and said holes in said sides of said socket being aligned with one another and adpated to receive a pin when said column is swung to a vertical position to hold said column in said vertical position.

* * * * *